United States Patent [19]

Kobayashi

[11] 4,007,955

[45] Feb. 15, 1977

[54] LOCKING APPARATUS

[75] Inventor: Fumio Kobayashi, Yokohama, Japan

[73] Assignee: Ohi Manufacturing Co., Ltd., Yokohama, Japan

[22] Filed: July 15, 1975

[21] Appl. No.: 596,142

[30] Foreign Application Priority Data

July 20, 1974 Japan ..... 49-86614
July 29, 1974 Japan ..... 49-89449

[52] U.S. Cl. ..... 292/216; 292/DIG. 43; 292/341.17

[51] Int. Cl.[2] ..... E05C 3/26

[58] Field of Search ..... 292/216, 341.16, 341.17, 292/254, DIG. 14

[56] References Cited

UNITED STATES PATENTS

| | | | |
|---|---|---|---|
| 2,660,765 | 12/1953 | Carlson | 292/254 X |
| 2,926,942 | 3/1960 | Krause et al. | 292/341.17 X |
| 3,312,491 | 4/1967 | Peters | 292/341.17 X |
| 3,572,066 | 3/1971 | Peters | 292/341.17 X |

*Primary Examiner*—Richard E. Moore
*Attorney, Agent, or Firm*—Holman & Stern

[57] ABSTRACT

A locking apparatus consisting of a latch member; a central portion of which is pivotally mounted and is provided with a locking notch at one side thereof and engageable with a striker; and a forwardly projecting member at the opposite side thereof engageable with a locking plate pivotally mounted on the striker; the locking plate being releasable from either the side where the striker is mounted or from the side where the latch member is mounted.

7 Claims, 2 Drawing Figures

LOCKING APPARATUS

FIELD OF THE INVENTION

This invention relates to locking apparatus, is of particular advantageous, though by no means exclusive, application to locking apparatus for trunk lid of motor vehicles, and also relates to locking apparatus wherein both internal and external release of the latch, in other words, a release of the latch both from inside and outside the vehicle, is obtainable with considerably small strength.

BACKGROUND OF THE INVENTION

According to the present invention, a locking apparatus has a striker mounted on one side of the trunk lid and has a latch member mounted on the corresponding side of the vehicle body, so as to save the space for attachment. At the same time, a locking apparatus has the striker and a locking plate engage respectively with both sides of the latch member pivotally mounted, in order to divide a locking reaction.

In the well known prior art similar to this invention, it has been a practice that a latch member is fixed to a trunk lid, while a striker being fixed to a vehicle body directly. Not only does this way of attachment cause, as everyone skilled in the art admits, a great damage to the trunk lid as a result of strength applied onto the striker being transferred to the trunk lid, but also it is impossible to release the latch from the inside of the vehicle. The prior art device, moreover, occupies too much space for attachment in relation to the other parts of the vehicle.

SUMMARY AND OBJECT OF THE INVENTION

The present invention, therefore, is provided to eliminate the above-mentioned problems encountered in the prior art.

Accordingly, it is one object to provide a locking apparatus wherein a division of the locking reaction is achieved by means of two engaging points so as to prevent an eccentric force from being applied onto the pivot of the latch member. It is another object of the present invention to provide a locking apparatus the latch of which can be released either from inside or from outside the vehicle.

The present invention will be further described and will be more apparent when taken in conjunction with the accompanying drawings, in which:

DESCRIPTION OF A PREFERRED EMBODIMENT

Figure 1:
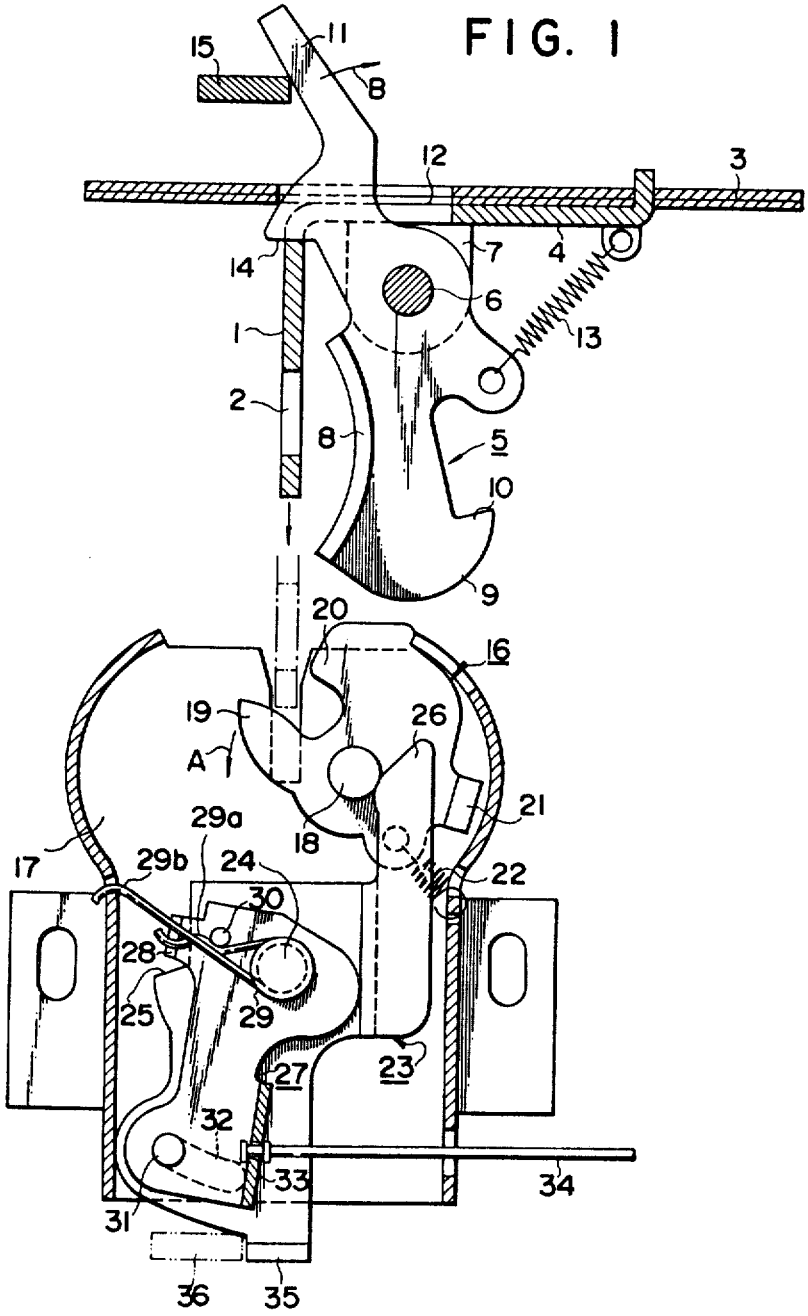
FIG. 1 shows a vertical cross sectional elevational view of a locking apparatus in accordance with the present invention, before a striker gets to engage with a latch.

An angular-shaped striker 1, having an aperture 2 disposed at the lower end of the downwardly bent portion thereof, is solidly mounted on the underside of a trunk lid 3 through a base plate 4 of the striker 1. It should be noted that a conventional trunk lid for motor vehicles usually comprises spaced metal sheets affording little space for installation of parts of a latch.

A locking plate 5, pivotally mounted on a downwardly directed bracket 7 of the striker 1 so as to turn about a pivot 6, consists of an arcuate side edge 8 disposed at the left side thereof, an arcuate lower edge 9 at its bottom portion, a hook 10 at its right side, and an outside lever 11 which is upwardly sticking out into the space of the trunk lid 3 through a slot 12 provided on the trunk lid 3.

A tension spring 13, disposed between the right-hand portion of the locking plate 5 and the right end of the striker 1, is urging a downward hook 14 of the locking plate 5 into a constant engagement with the upper end portion of the striker 1.

Within the trunk lid 3, there is provided a key-operated plate 15 horizontally movable so as to push the outside lever 11 to the unlatched position.

There is also provided a latch 16 pivotally mounted on a body 17 by a pivot 18 directly at the rear of the locking plate 5 during lid closure, said latch having at the left side an engagement member 19 with which the bottom edge of the striker 1 is positioned in engagement condition during lid closure and which serves to give a turning moment to a disc of the latch 16 in an anti-clockwise direction, a locking notch portion 20 engageable with the aperture 2 of the striker 1 when the latch 16 pivoting toward a latching position in an anti-clockwise direction, and a forwardly bent-up flange 21 which engages with the hook 10 during closure of the trunk lid 3.

The latch 16, at the lower end portion thereof, provides a hole (no numeral) for anchoring a tension spring 22, the other end of which is anchored to the right portion of the body 17.

At an almost central portion of the body 17, there is further provided a releasing lever 23, pivotally mounted on a pivot 24, with an engaging portion 25 disposed at the upper left side thereof and with a striking head 26 engageable with arcuate side edge 8 of the locking plate 5 after an anti-clockwise turning of the disc-like latch 16. In this instance, it is imperative that the releasing lever 23 should be disposed in such a way that the striking head thereof is in front position of the locking plate 5.

An inside lever 27, the mechanism of which is one of the most advantageous devices over the prior art, is pivotally mounted on the same pivot 24 as that of the releasing lever 23, comprising a rearwardly bent-up flange 28 disposed so as to be engageable with the engaging portion 25 of the releasing lever 23.

A torsion spring 29, one end **29*a* of which is supported by an anchorage 30 of the inside lever 27 while the other end 29*b* being hooked on a side edge of the body 17, surrounds the pivot 24 and acts on the inside lever 27, to which a turning moment in a clockwise direction is thus continuously applied. The torsion spring 29 simultaneously acts on the releasing lever 23** for the same purpose.

A pin 31, fixed to the lower end portion of the inside lever 27, is passing through an arcuate slot 32 which is slotted at the bottom part of the releasing lever 23 with its center coincident with an axis of the pivot 24, and is positioned in constant engagement with the left-hand inner wall of the slot 32 so as to prevent the inside lever 27 from turning back any further in a clockwise direction. It may also be possible to fix pin 31 on the releasing lever 23 and make an arcuate slot 32 on the inside lever 27. There is Further provided a forwardly bent-up flange 33, to which an operating rod 34 extending from the inside of the vehicle is connected.

A locking apparatus, formed in accordance with the present invention, is thus comprising what have been described heretofore.

In operation, when closing a trunk lid 3, the bottom edge of the striker 1 urges the engagement member 19 downward (as shown by an arrow A) and consequently has the latch 16 turn about the pivot 18 against the tension of the spring 22 in an anticlockwise direction.

Once the complete closure of the trunk lid 3 is achieved, the locking notch portion 20 of the latch 16 is in tight engagement with the aperture 2 of the striker 1.

Thus, during a downward movement of the striker 1 which causes the engagement member 19 to turn against the tension spring 22, the forwardly bent-up flange 21 at the right lower side of the latch 16 pivotally turning on the pivot 18 in an anti-clockwise direction is moving upward concentrically with the pivot 18 along the periphery of the arcuate lower edge 9 of the locking plate 5.

As the flange 21 is urged to move up close to the upper edge of the arcuate lower edge 9, a clockwise directional turning moment is gradually applied to the locking plate 5, which, as a result, turns about the pivot 6 in such a direction as shown by an arrow B.

Then, no sooner does the flange 21 pass over the arcuate lower edge 9 — it is nearly when the flange 21 is horizontally aligned with the pivot 18 — than both the flange 21 and the hook 10 are brought to engage with each other and are retained in the perfectly-latched condition.

It is therefore understood that during the complete closure of the trunk lid 3, i.e., during the perfectly-latched condition, the locking notch portion 20 of the latch 16 is engaging with the aperture 2 of the striker 1 and, at the same time, the flange 21 of the latch 16 is engaging with the hook 10 of the locking plate 5. In this instance, what is most noteworthy in the present invention is the fact that, because the locking reaction is divided at two engaging positions mentioned above, the pivot 18 of the latch 16 can be kept from any deformation or any damage by an eccentric force.

Figure 2:
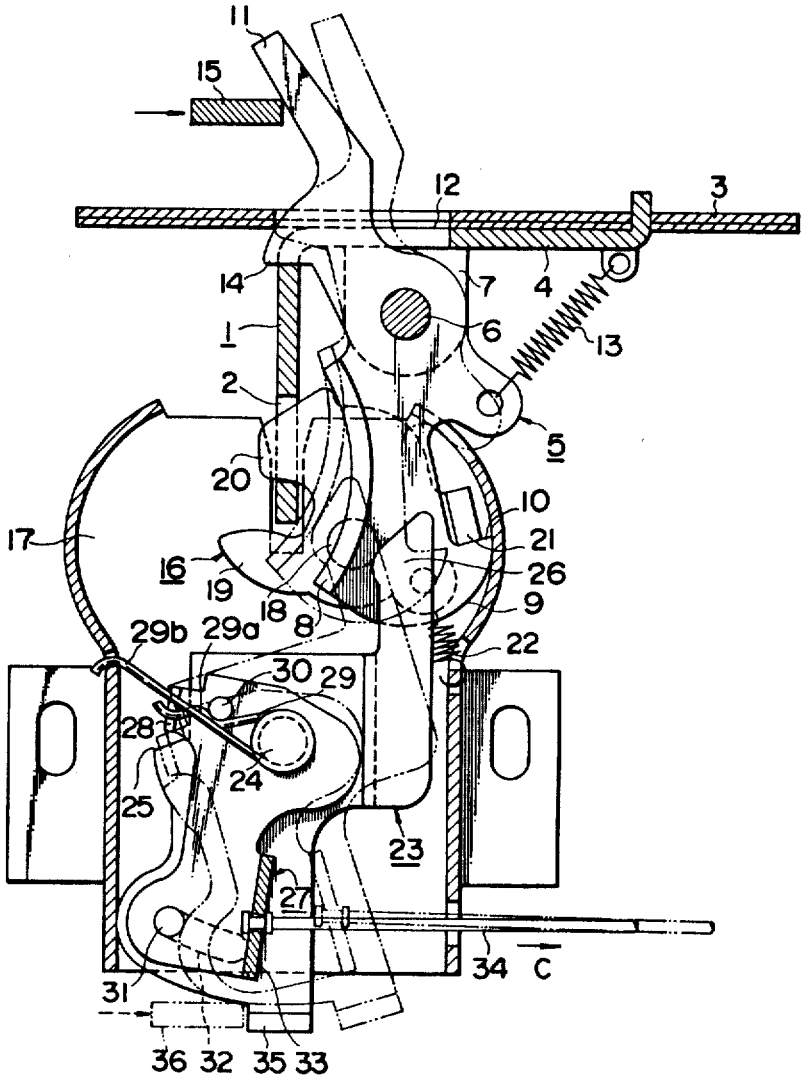
FIG. 2 similarly shows a vertical cross sectional elevational view of the same, after the striker is in engagement with the latch.

On the other hand, the outside lever 11 may be pushed either manually or by means of the key-operated plate 15 so as to turn the locking plate 5 about the pivot 6 in a clockwise direction up to the position shown by a phantom lines in FIG. 2.

It will be thus understood that the tension of the spring 22 gives the latch 16 a clockwise-directional turning-back moment and the locking notch portion 20 is thus released from the engagement with the aperture 2 of the striker 1 since the flange 21 of the latch 16 is no longer in engagement with the hook 10 of the locking plate 5.

Thus, a person may notice that the locking apparatus disposed between the trunk lid 3 and the vehicle body is now off the latch as the trunk lid 3 is appreciably lifted up by means of the reactionary force caused by the latch release.

If the operating rod 34 operatable inside the vehicle is pulled toward the direction shown by an arrow C, the internal release of the latch 16 can easily be achieved. In this instance, the inside lever 27 is pulled simultaneously and turned about the pivot 24 against the tension spring 29, and the pin 31, disposed fixedly on the inside lever 27 and passing through the arcuate slot 32 of the releasing lever 23, moves along the slot 32. Together with the turning movement of the inside lever 27, the rearwardly bent-up flange 28 thereof moves downward to the position where the flange 28 engages with the engaging portion 25, so as to turn the releasing lever 23 counterclockwise.

At the same time, the turning movement of the inside lever 27 brings about an engagement of the striking head 26 of the releasing lever 27 with the arcuate side edge 8 of the locking plate 5 so that the locking plate 5 is compelled to go round on the pivot 6 against the tension spring 13 in a clockwise direction so far as the hook 10 thereof becomes free from the engagement with the forwardly bent-up flange 21 of the latch 16. Further, the latch 16 therefore turns back to the original position by means of the tension spring 22, whereby the locking notch portion 20 can be disengaged from the aperture 2 of the striker 1. In this case, the trunk lid 3 can be said to be in an entirely unlatched condition.

In another embodiment of the present invention with respect to the bi-directional release of the latch, it may be appreciated that a flange-like member 35 disposed at the lowest end of the releasing lever 23, and another key-operated plate 36 horizontally movable and operatable from the outside of the vehicle, do perform the same function as mentioned above. In other words, a lateral force of the key-operated plate 36 applied onto the flange-like member 35 effects an anti-clockwise directional rotation of the releasing lever 27 and thus the release of the latch 16 can be achieved in the same way.

In operation, a person may easily put the trunk lid 3 off the latch from the inside of the vehicle with considerably small strength since all he has to do is merely to turn the locking plate 5 a little about the pivot 6 against the tension spring 13.

Another advantage of the present invention is that the present locking apparatus does not need so much space for attachment as the prior art because the striker 1 and a greater part of the locking plate 5 are mounted under the trunk lid 3.

A still further advantage of the present invention is that there is an appreciable time-lag before the releasing lever 23 begins to work to release the latch 16. In other words, even if the operating rod is pulled from the inside of the vehicle to turn the inside lever 27 mounted coaxially with the releasing lever 23 against the tension spring 30, the releasing lever 23 does not work instantly because, as can be seen in the related figures, it takes a little time, though not longer than a second, prior to the engagement between the rearwardly bent-up flange 28 and the engaging portion 25. This characteristic mechanism of this invention offers such an advantage that an erroneous operation of the operating rod 34 can be avoided so long as a person does not keep on pulling the rod 34 in a certain time long.

Although embodiments of the present invention have been described in detail herein by way of the accompanying drawings, it should be understood that the invention is not limited to the embodiments described heretofore, and that various modifications and changes may be inferable without departing from the scope or the concept of the present invention.

What I claim is:

1. A locking apparatus for a trunk lid of a motor vehicle or the like comprising:

a striker rigidly mounted on the underside of a trunk lid for movement therewith, said striker including a lower aperture portion;

a locking plate pivotally mounted on said striker, said locking plate including a hook opposite said striker;

a body fixed in the path of movement of said striker;

a latch pivotally mounted on said body, said latch having an engagement member at one side for engagement by said striker for pivoting said latch, said latch having a notch portion, spaced from said engagement member for sequential receipt in the lower aperture portion of said striker after the striker has engaged said engagement member of said latch, said latch having a flange opposite said notch portion engageable with said hook; and unlatching means for disengaging the latch from said striker and locking plate.

2. The structure as claimed in claim 1 in which said unlatching means comprises a lever integral with said locking plate, and a releasing lever pivotally mounted on said body so that the locking apparatus can be unlatched by operation of either the lever integral with the locking plate or the releasing member on said body.

3. The structure as claimed in claim 2 including operating means optionally engageable with either said lever integral with the locking plate or the releasing lever on said body.

4. The structure as claimed in claim 2 in which operation of said lever and releasing lever are manually operable for separating the striker and locking plate from said latch.

5. The structure as claimed in claim 2 in which the lever integral with the locking plate is accessible exteriorly of said lid, and said releasing lever is disposed within said lid.

6. The structure as claimed in claim 1 including biasing means operatively connected to said locking plate, latch and releasing lever for normally urging the locking apparatus in closing relationship.

7. The structure as claimed in claim 9 in which said releasing lever is connected to an operating rod for operation within a motor vehicle.

* * * * *